United States Patent [19]

Wright

[11] Patent Number: 4,573,055

[45] Date of Patent: Feb. 25, 1986

[54] DIRECTIONALLY SENSITIVE RECEIVING ANTENNA

[76] Inventor: Thomas M. B. Wright, 5 Arnwood Mews, The Tene, Baldock, Hertfordshire SG7 6LA, England

[21] Appl. No.: 329,132

[22] Filed: Dec. 9, 1981

[51] Int. Cl.[4] ..... H01Q 1/36; H01Q 21/20

[52] U.S. Cl. ..... 343/787; 343/350

[58] Field of Search ..... 343/787, 788, 350, 417, 343/754, 853

[56] References Cited

U.S. PATENT DOCUMENTS

| | | | |
|---|---|---|---|
| 2,994,084 | 7/1961 | Miller | 343/754 |
| 3,013,266 | 12/1961 | Wheeler | 343/754 |
| 3,020,547 | 2/1962 | Granquist | 343/841 |
| 3,246,332 | 4/1966 | Waldman et al. | 343/754 |
| 3,369,242 | 2/1968 | Johnson | 343/787 |
| 3,371,347 | 2/1968 | Carter | 343/417 |
| 3,845,417 | 10/1974 | Zaleski | 343/787 |

*Primary Examiner*—Eli Lieberman

*Attorney, Agent, or Firm*—Cushman, Darby & Cushman

[57] ABSTRACT

A directionally sensitive receiving antenna, particularly for microwave radiation, utilizes the change in impedance, as a function of the angle between the energy vector of incident radiation on a gyrotropic medium, e.g. a ferrite material, and a magnetic field passing through the medium, enabling a highly directional antenna of small physical dimensions to be constructed.

1 Claim, 9 Drawing Figures

DIRECTIONALLY SENSITIVE RECEIVING ANTENNA

BACKGROUND OF THE INVENTION

1. Field of the Invention

This invention relates to the use of gyrotropic material such as ferrites to construct devices having high angular sensitivity to microwave radiation by virtue of the directivity inherent in the relation for the refractive index of an electro-magnetic wave propagated in a gyrotropic medium.

2. Prior Art

A gyrotropic medium is one whose properties are isotropic in the absence of a magnetic field, but which exhibits anisotropy, i.e. quantitative differences in measurements of the same properties along different crystal axes, when such a field is applied. This characteristic arises in ferrite materials as a consequence of the effect of the field on the electron spin component of the magnetic moment of the atomic lattice, and is the basis of the non-reciprocal properties which are extensively used in ferrite circulators and isolators and many other waveguide and microstrip circuit elements at microwave frequencies.

The continual decrease in size, and increase in power and sensitivity, of solid state transmitters and receivers in the microwave frequency band now makes the relatively large size of the antenna structure required in many microwave systems an inconvenient anomaly. While devices using the well-established techniques of phased arrays and aperture synthesis may be utilised to reduce structure dimensions, a lower limit remains which is essentially determined by the wave length of the radiation and the dimensions of the radiating aperture.

BRIEF SUMMARY OF THE INVENTION

According to this invention, there is provided a method and apparatus by which the direction of electro-magnetic radiation, more particularly microwave radiation, incident on the apparatus is determined by measuring the change in impedance presented to a wave component within a gyrotropic medium, e.g. ferrite material, as a function of the angle between the energy vector of the incident radiation and a magnetic field passing through the medium. Although reference is made more particularly to incident radiation, the method or apparatus may be used in a directional transmitter, subject however to the power handling capacity of the gyrotropic material.

The directivity utilised in this invention is obtained on the atomic scale and is in consequence not limited by the theory of array optics. It is also distinguished from the phenomena used in devices depending upon ferrite loaded coils or array elements to give directivity through their effect on the inductance of a tuned circuit.

In the large majority of microwave systems in which antennae are employed, they provide one or more of the prime functions of the directivity, gain and selectivity, and in most conventional antenna designs all three of these features are inherent, although one may be more significant than the others in a particular application.

The purpose of this invention is to furnish a simple means of providing directivity, in a form whereby the features of gain and selectivity may be readily obtained by other physical processes which permit of convenient integration within a single apparatus. This invention is directed primarily to utilisation in systems where the determination of the direction of a received microwave signal is of importance, since the power saturation properties of ferrites place limitations on their use as a transmitting element.

The essential features of propagation of an electromagnetic wave in a ferrite material are contained in a relation first defined by Polder in 1948 (See Polder, D: "On the Theory of Ferromagnetic Resonance" Phil. Mag. Vol 40 (1949) Pages 99–115) and having the form:

$$\frac{n_{\pm}^2}{\epsilon} = \frac{\gamma^2 B_c (H_c + 2\pi M_o \sin^2\theta) - \omega^2}{\gamma^2 H_c (H_c + 4\pi M_o \sin^2\theta) - \omega^2} \pm \frac{[(2\pi\gamma^2 B_c M_o \sin^2\theta)^2 + (4\pi\gamma\omega M_o \cos\theta)^2]^{\frac{1}{2}}}{\gamma^2 H_c (H_c + 4\pi M_o \sin^2\theta) - \omega^2} \quad (1)$$

in C.G.S. Units where:

$H_o$ is the constant external field $M_o$ is the saturation magnetisation of the ferrite $B_c = H_c + 4\pi M_o$ $N_z$ is the demagnetising factor $H_c = H_o - N_z M_o$ $\gamma$ is the gyromagnetic ratio $\omega$ is the frequency of the signal $\theta$ is the angle between the directions of $H_o$ and the received signal $\epsilon$ is the dielectric constant of the ferrite $n_{\pm}$ are the refractive indices of the waves propagating in the ferrite medium.

This relation shows that in general, two waves are propagated having refractive indices $n_{\pm}$ and the large majority of current wave guide and micro-circuit elements in present use, e.g. circulators, isolators, phase shifters etc., utilise one or other of the limiting conditions $$\theta = 0°$$

or $$\theta = 90°$$

In general, however, it will be seen that at any intermediate angle between the direction of propagation and the applied magnetic field there will exist two wave components having certain differences in their responses to changes in the various parameters of Polder's equation. FIG. 1 of the accompanying drawings shows these in generalised form from which it will be seen that there are two values of the wavelength within the ferrite for which $n_{\pm}$ has maxima. Since, due to the form of Polder's equation a generalised quantitive analysis of these conditions in terms of arbitrary values of $\theta$ is extremely complex, it is convenient in practice to select the value $\theta = 45°$ for detailed consideration since this corresponds to certain conditions of symmetry between the wave vectors within the ferrite medium which lead to simplifications in the configuration of apparatus embodying the desired responses, as well as means for cancelling the effects of variations of temperature and stray magnetic fields.

When this is done, making also the assumption that the demagnetising factor $N_z$ is $4\pi$, corresponding to the worst case, the expression for the refractive index becomes $$n_{\pm}^2 = \epsilon \cdot \frac{P(P - 3Q/4) - 1 \pm (P^2 + 8)^{\frac{1}{2}} Q/4}{(P - Q)(P - Q/2) - 1} \quad (2)$$

where $$P = \frac{\gamma H_o}{\epsilon} \text{ and } Q = \frac{4\pi\gamma M_o}{\omega}$$

In order to construct a practical device for detecting changes in the electrical responses with respect to an incident wave front it is necessary to establish means for measuring change of impedance in a circuit as a function angle of incidence.

Since the refractive index of a medium is given by $$n = \sqrt{\mu\epsilon}$$

where $\mu$ and $\epsilon$ are the relative permeability and permittivity respectively and the characteristic impedance $z_o$ is given by $$z_o = \sqrt{\frac{\mu}{\epsilon} \frac{\mu_o}{\epsilon_o}}$$

where $\mu_o$ and $\epsilon_o$ are the corresponding parameters for free space, it follows that a partial derivative of $z_o$ has the form:

$$\frac{\partial z_o}{\partial x} = \frac{377}{\epsilon} \frac{\partial n}{\partial x}$$

where x is any variable.

This becomes:

$$\frac{\partial z_o}{\partial \theta} = \frac{6.58}{\epsilon} \frac{\partial n}{\partial \theta} \text{ Ohms/degree}$$

Thus a sensitivity coefficient $\Lambda_{\pi/4}^{\pm}$ may be defined by:

$$\Lambda_{\pi/4}^{\pm} = \left(\frac{\partial n}{\partial \theta}\right)_{\pi/4}^{\pm} =$$

-continued $$\frac{\frac{n}{2} \times \left[\left(\gamma B_c - \frac{2n^2}{\epsilon} H_c\right) \pm \frac{\gamma^2 B_c^2 - 4\omega^2}{(\gamma^2 B_c^2 + 8\omega^2)^{\frac{1}{2}}}\right]}{\frac{\gamma^2 B_c(H_c + \pi M_o) - \omega^2}{\pi\gamma M_o} \pm (\gamma^2 B_c^2 + 8\omega^2)^{\frac{1}{2}}}$$

$$= \frac{nPQ \times \left[1 - 2\bar{\mu}_{\pm} \pm \frac{1}{P} \cdot \frac{P^2 - 4}{(P^2 + 8)^{\frac{1}{2}}}\right]}{8 \times \left[P\left(P - \frac{3Q}{4}\right) - 1 \pm (P^2 + 8)^{\frac{1}{2}} \frac{Q}{4}\right]}$$

where $\mu$, the permeability tensor is related to n by $n^2 = \epsilon\bar{\mu}$.

It may be noted from this that the numerator of $n^2$ is equal to one eighth of the denominator of $\Lambda$ so that even when the refractive index is very small it may be possible to find conditions yielding large $\Lambda$.

This relation may be used to establish the conditions under which the waves will propagate for various values of the angle $\theta$ between the direction of propagation and that of the applied magnetic field, and the sign of the angle coefficients $\Lambda_{\pm}$ relative to the resonance loci in the (P, Q) plane.

The results are shown in FIG. 2 for the 45° case. Unity on the Q axis may be taken to correspond to YIG (Yttrium Iron Garnet) at 5 GHz, and on the P axis to an applied magnetic field of 10 GHz.

In a practical (i.e. non-infinite) sample, these curves will look very different: Moreover, the rate of variation of $\Lambda_{\pm}$, and hence the form of the angle discrimination characteristic, will itself change rapidly near resonance. The crucial point of this figure is that small perturbations of $\theta$ are likely to yield discrete changes in the modes of energy transmission, which will be manifest by sharply defined conditions for extinction and creation of either or both waves. It is also clear that devices with different combinations of the signs of $\Lambda_{\pm}$ may be feasible, allowing configurations in which differential compensation of temperature effects and material inhomogeneity etc., may be obtained.

Typical values of $\mu$ and Y are shown in Table I, which shows the change of sign in Y on each side of resonance, where $$Y = \frac{8}{\sqrt{\epsilon}} \Lambda$$

TABLE I

| P | Y+ | | | | | | Y− | | | | | |
|---|---|---|---|---|---|---|---|---|---|---|---|---|
| Q | .4 | .5 | .6 | 2.6 | 2.7 | 2.8 | .4 | .5 | .6 | 2.6 | 2.7 | 2.8 |
| 2.0 | 108 | 16 | 9 | — | −259 | −77 | 328 | 23 | 10 | 245 | −53 | −24 |
| 2.1 | −44 | 37 | 13 | — | — | −226 | — | 81 | 20 | 47 | 1091 | −50 |
| 2.2 | −18 | −235 | 22 | — | — | −9118 | — | — | 47 | 28 | 58 | −605 |
| 2.3 | −12 | −29 | 72 | — | — | — | — | — | 295 | 21 | 32 | 73 |
| 2.4 | −9 | −16 | −61 | — | — | — | — | — | — | 18 | 24 | 38 |
| P | μ+ | | | | | | μ− | | | | | |
| Q | .4 | .5 | .6 | 2.6 | 2.7 | 2.8 | .4 | .5 | .6 | 2.6 | 2.7 | 2.8 |
| Q | | | | | | | | | | | | |
| 2.0 | 0.29 | 0.25 | 0.21 | — | 22 | 10 | 71.7 | 12 | 6.7 | 1.52 | 1.49 | 1.47 |
| 2.1 | 0.28 | 0.24 | 0.2 | — | — | 20 | — | 25 | 9.5 | 1.56 | 1.53 | 1.51 |
| 2.2 | 0.27 | 0.23 | 0.19 | — | — | 220 | — | — | 16 | 1.60 | 1.57 | 1.55 |
| 2.3 | 0.26 | 0.22 | 0.19 | — | — | — | — | — | 51 | 1.65 | 1.62 | 1.59 |
| 2.4 | 0.25 | 0.22 | −18 | — | — | — | — | — | — | 1.70 | 1.66 | 1.63 |

(The use of Y as defined above allows the angular sensitivity to be expressed independently of $\epsilon$).

On FIG. 2, for a constant frequency, changes in P correspond to a change in magnetic field: Similarly changes to Q correspond to changes in $4\pi M_o$: i.e. variation in the composition of the ferrite.

Thus assuming constant field and same material variations in frequency appear as straight lines passing through the origin. This may be used to permit evaluation of the bandwidth characteristics in a practical situation, when $\Lambda$ may be plotted as in FIG. 3, where a value for $4\pi M_o$ of 1750, appropriate to yttrium iron garnet has been assumed, and resonance is assumed at an applied frequency of 1.3 GHz. From this it is apparent that $\Lambda$ changes by only 2 to 1 in 150 MHz (between the points A and B) for the wave component that is propagated in the low frequency side of the resonance.

It is clear that, for values of other than 45°, and for demagnetising factors other than $4\pi$ the quantitative considerations become more complex. The description of the phenomena on which the invention is based as given above and in the accompanying figures, will nevertheless remain qualitatively correct and the effect of variation in these parameters can be obtained from a suitably programmed computer by perturbation methods.

In the following description of the invention it is therefore to be understood that the angle between the direction of magnetisation and the incident radiation may be selected to be other than 45° where this may be shown to be a more favourable configuration compatible with the incorporation of the features previously described.

For further theoretical consideration of electro-magnetic propagation in ferrite materials, reference may also be made to:

Damon, R. W. an Eshbach, J. R.: "Magnetostatic Modes of a Ferromagnetic Slab" J.Phys. Chem. Solids Vol 19 (1961) p. 308–320; and Yamada, S.; Chang, N. S.; Matsuo, Y: "Energy Analysis for the Amplification Phenomena of Magnetostatic Surface Waves in a YIG-Semiconductor Coupled System" IEEE Trans. MIT 25 No.7, 1977, p.600–605.

Figure 3:
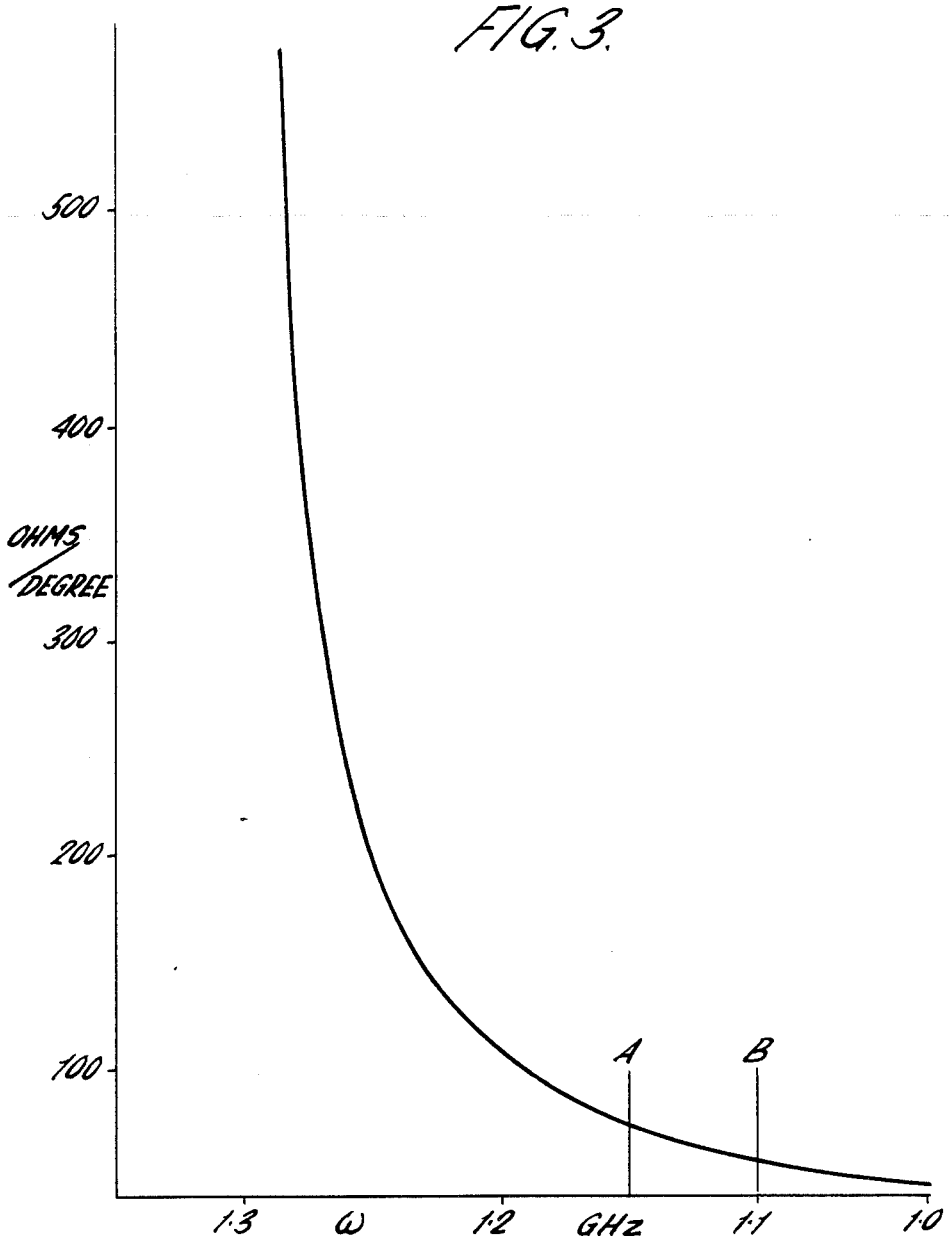
Figure 4:
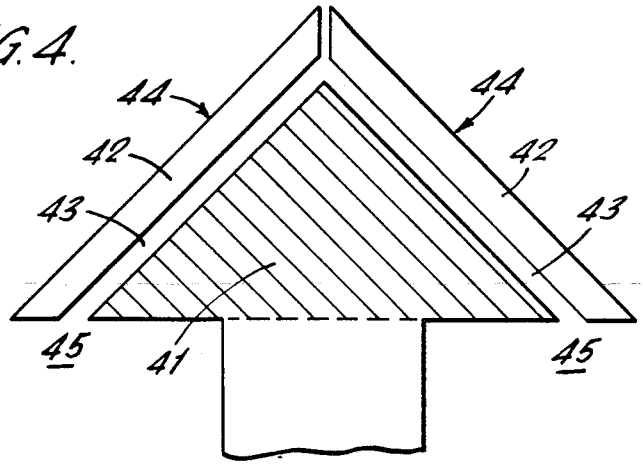
Figure 5:
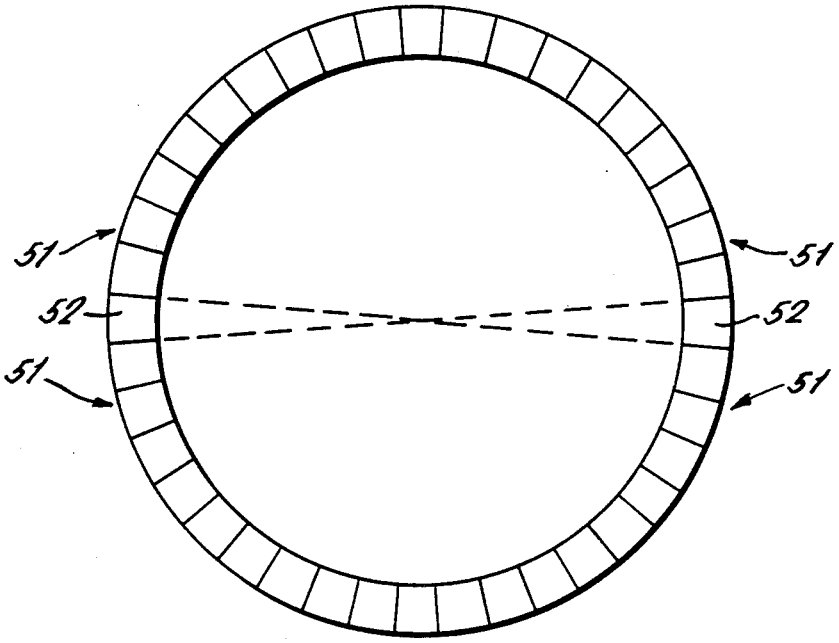
Figure 6:
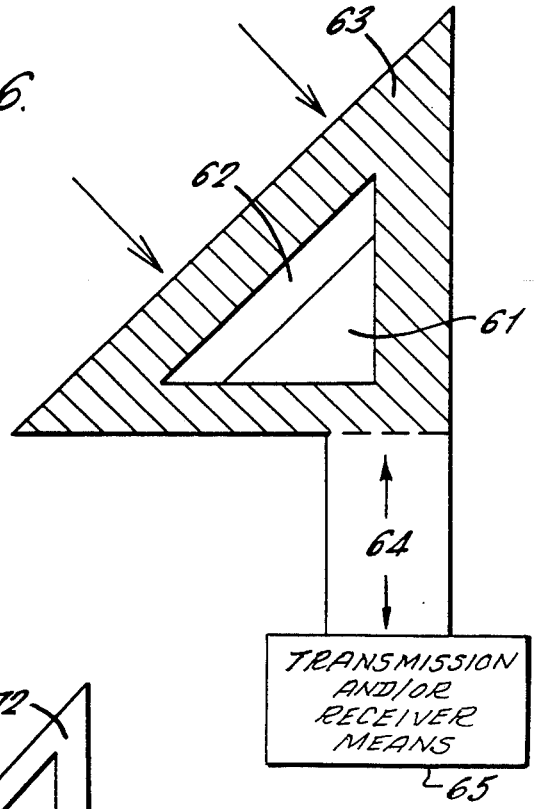
Figure 7:
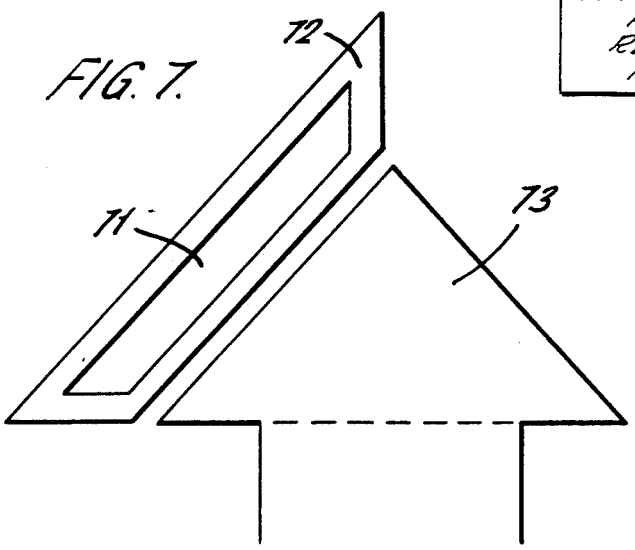
Figure 8:
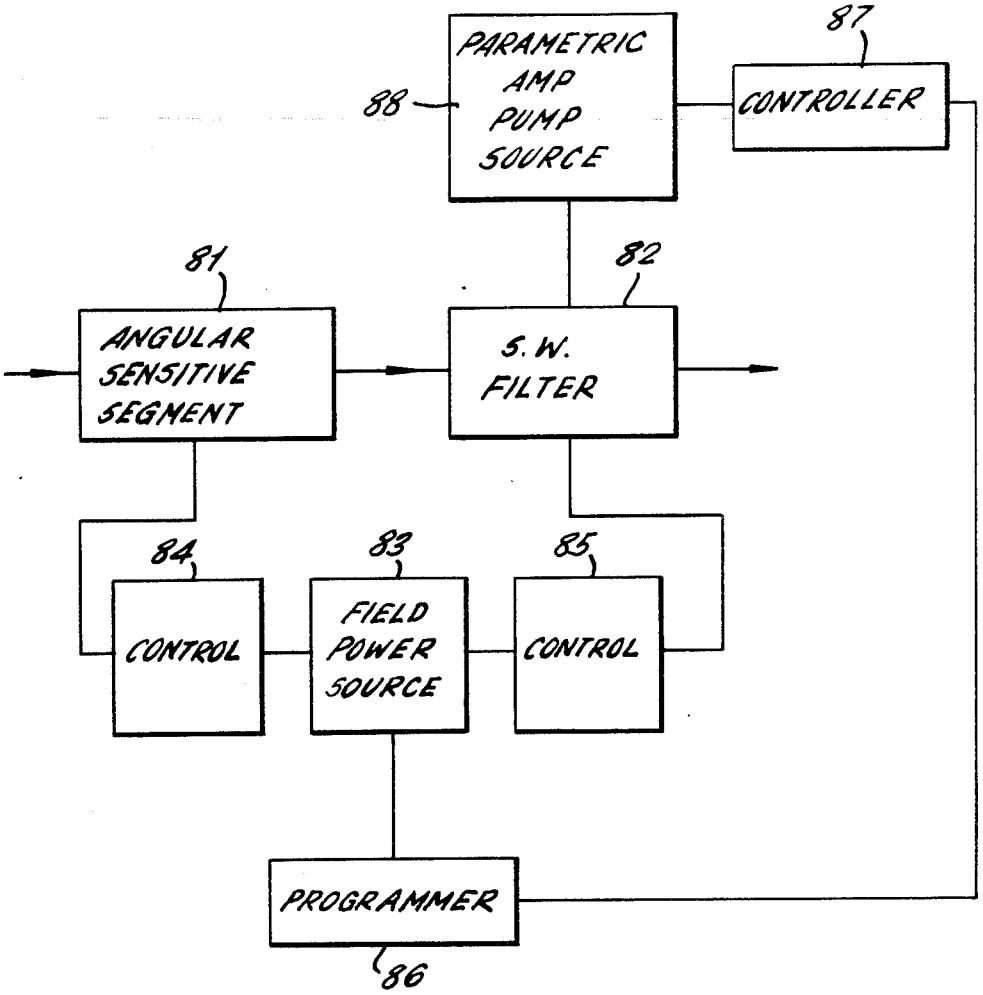
Figure 9:
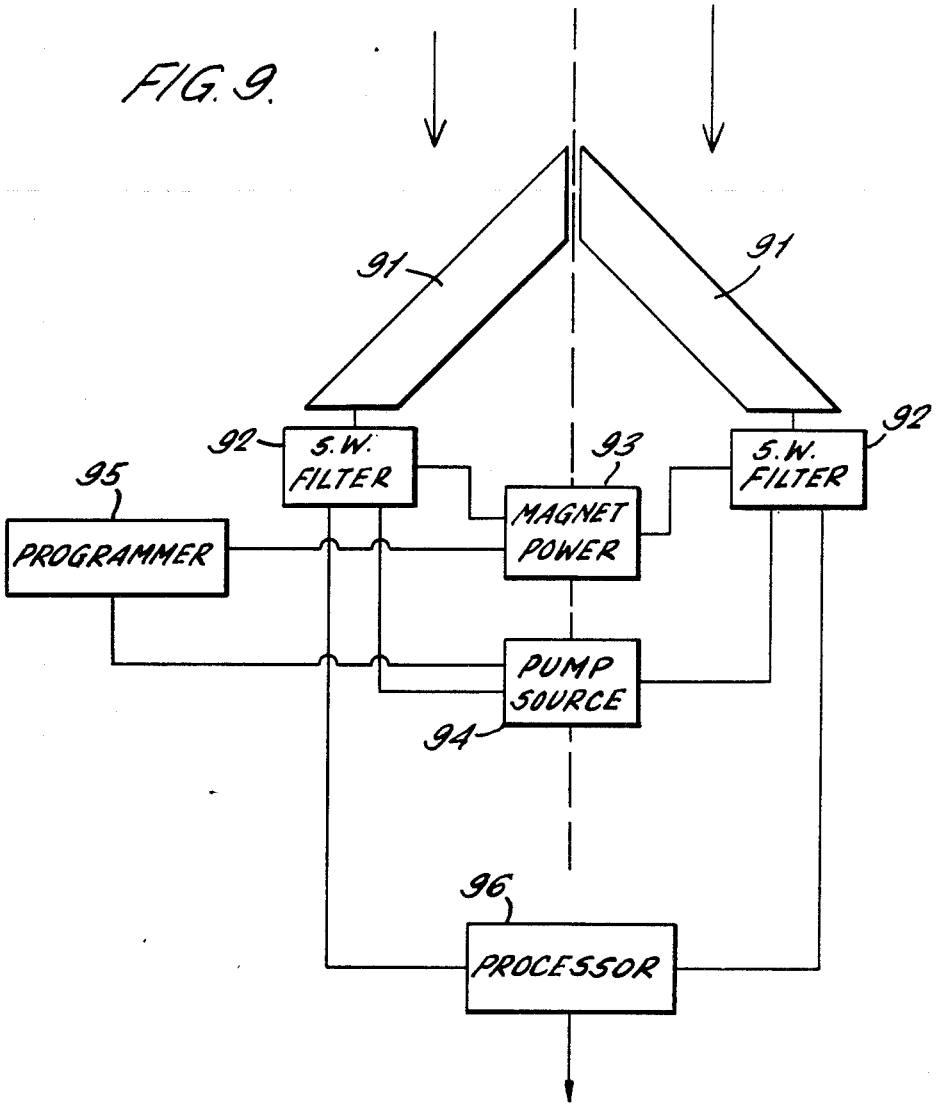

FIG, 2, also referred to above, is a graphical diagram, showing the condition within the P,Q plane in which propagation can occur;

FIG. 3 is a further graphical diagram showing the relationship between sensitivity and frequency in a specific medium;

FIG. 4 is a diagram illustrating a magnetic pole piece with ferrite material used in one embodiment of the invention;

FIG. 5 is a diagram illustrating the base of the element of FIG. 4;

FIGS. 6 and 7 are diagrams illustrating further antennae elements;

FIG. 8 illustrates diagrammatically a receiving system embodying the invention; and FIG. 9 is a diagram illustrating one configuration of the apparatus.

DESCRIPTION OF THE PREFERRED EMBODIMENTS

In one embodiment of the invention there is provided a magnetic pole piece in the form of a right circular cone as shown at 41 in FIG. 4 surrounded by a coating of ferrite material 42 which may be directly in contact with the pole piece or separated from it either by solid dielectric or an air gap 43. On the external surface of the ferrite may also be a coating 44 of a substance having the property of electrically matching the ferrite to free space and facilitating propagation of a wave within the ferrite so that it may be extracted at the base of the cone 45.

In the plane immediately above and below the plane of FIG. 4 are provided thin surfaces of material permitting electrical isolation between segments of the ferrite and its associated dielectrics around the base of the cone as shown in 51 in FIG. 5, which is a view of the base along the axis.

Thus for any pair of segments diametrically opposed across the base of the cone as at 52 in FIG. 5 it is apparent, by reference to FIG. 4 which effectively shows a pair of such segments in the plane of the paper, that when the direction of the incident radiation following upon the cone coincides with its axis, the outputs from these segments will be equal and appropriate to the impedance presented by the ferrite material for the 45° condition between the magnetic field and the incoming radiation. For a small displacement off this angle the impedance in one segment will increase and in the other decrease, since the values of the sensitivity coefficients $\Lambda$ will be equal and of opposite sign. The outputs of these segments may thus be readily combined in a simple differencing network to yield a sensitive measure of the angular change.

If the incident wave is linearly polarised, the response so obtained will clearly be greater for the segment pairs which lie in the plane of the magnetic field component and less for the other segments according to a sinusoidal variation of the out-of-plane angle. By cross-coupling the outputs from all segment pairs the sensitivity will nevertheless be significantly greater than that from a single pair and this configuration also ensures a response irrespective of the polarisation of the incident wave. From the foregoing it is however obvious that optimum performance will be obtained with a circularly polarised wave.

According to another embodiment of this invention the elementary segments may be constructed in the form of thin wave guide horns shaped in the plane of the cone axis as in FIG. 6, where the magnetic field is provided by means of a complex ferrite such as samarium cobalt 61 and the angular sensitivity by a coating of non-magnetic ferrite mounted upon it 62. The compound ferrite structure may be conveniently moulded into a dielectric filling the wave guide horn and shown hatched at 63.

The output impedance at the port 64 (output to a conventional receiver means illustrated at 65 in FIG. 6) will depend upon the loading effect of the dielectric and the magnetic ferrite which in turn will be modified by the sensitivity co-efficient $\Lambda$ of its angle sensitive coating, and the outputs from assemblies of diametrically opposed horns may be combined as described above. By introducing microwave power at the port 64 (illustrated by a conventional transmission means at 65 in FIG. 6) this form of the invention may be utilised as a transmitting element, subject to power limitations imposed by saturation effects in the ferrite materials.

This aspect of the invention may alternatively be implemented in Microstrip form according to FIG. 7 in which the elementary angle sensitive segments consist of a thin film of ferrite 71 embedded in a dielectric slab 72. Conducting surfaces are provided on the upper and lower faces of the dielectric slab such that the assembly constitutes a wave guide loaded with the angle sensitive ferrite. A number of such elementary segments may be assembled about a conical magnetic pole piece 73 and cross connected as described above. It may be seen that this form of construction resembles that of microstrip circuits and resonators employing ferrite films, with the difference that the magnetic field lies in the plane of the ferrite instead of normal to it. Thus well established theoretical and practical techniques may be utilised to determine the optimum design configuration for the implementation of the invention in this form.

Figure 1:
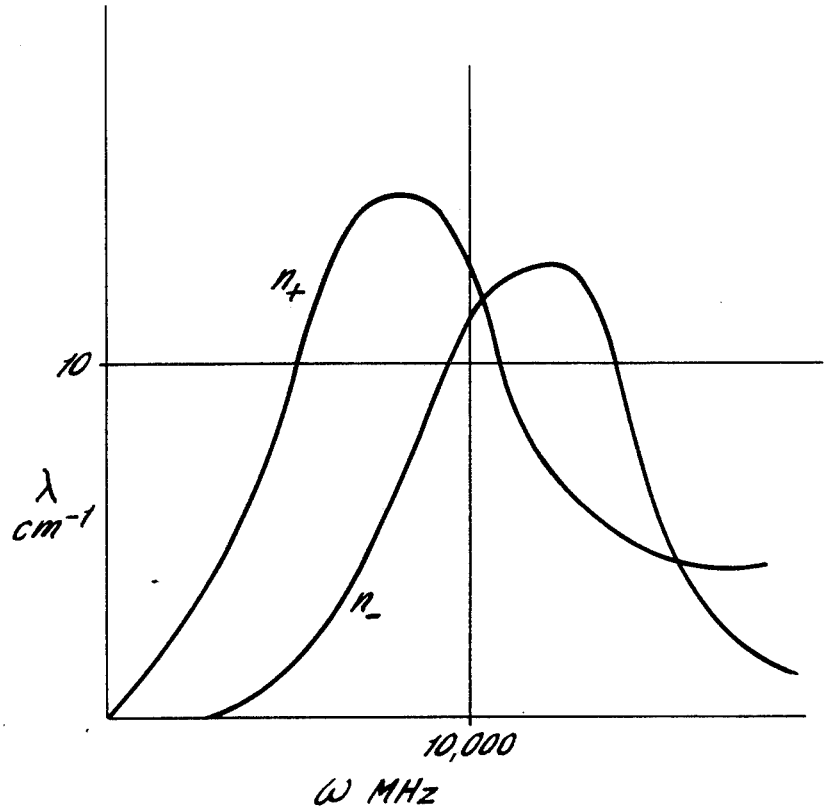
FIG. 1 referred to above, is a graphical diagram showing the relation between refractive indices and frequency in a ferrite medium.
Figure 2:
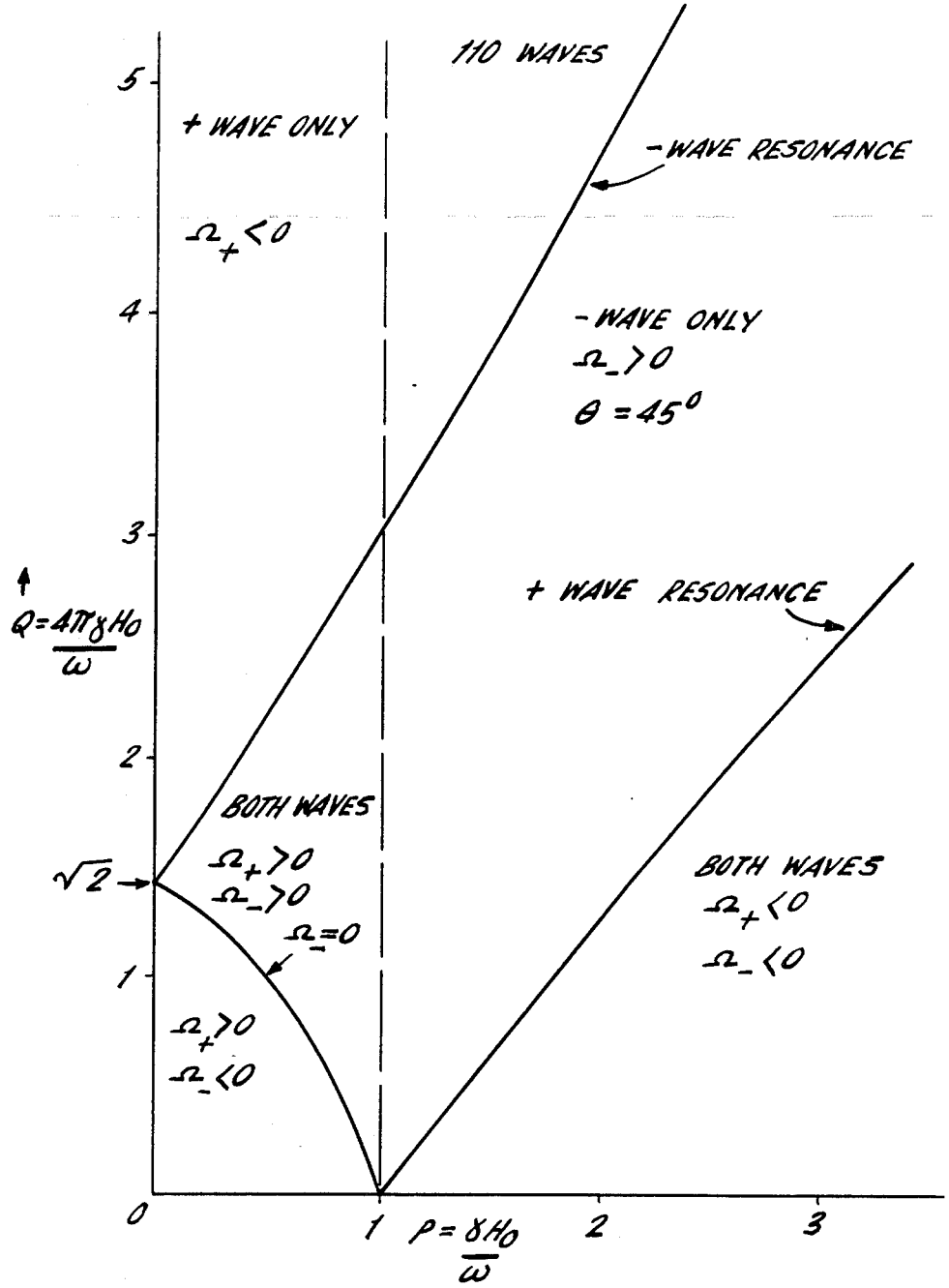

The operation of the invention has so far been described in terms of only one of the two wave components predicted by Polder's equation. However, by reference to FIG. 2 it is clearly possible to make practical use of the fact that for a single value of P two values Q can be found to yield a resonance, i.e. two different ferrites will yield resonances for the same applied field and frequency. Similarly two values of P can be found to yield resonances for the same material, implying that two values of magnetic field can yield resonances at the same frequency.

Since this double valued property will necessarily extend to other resonance situation, areas can be found in the PQ plane where $\Lambda_+$ and $\Lambda_-$ have equal and opposite signs. By extracting corresponding dual signals from each of the individual segments described above their angular sensitivity can be enhanced by simple sum and differencing circuit techniques.

Also, from the denominator of equation (2) it may be shown that for real positive values of Q two resonance conditions can be obtained only if $P>1$. This locus in the PQ plane determines the cut-off condition for one of the wave components. Since this will in general be attended by a change in the power propagated through the ferrite and since also the position of this boundary will change for variations about the 45° position, it offers additional means of detecting and enhancing the angular sensitivity.

From the form of the numerator of $\Lambda_\pm$ as given in equation (3), it is further clear that changes of sign will arise as a consequence of the variation of the term in P with respect to the value of $\bar{\mu}$ and that this in turn offers an additional degree of freedom in the selection of the operating conditions in the P, Q plane for a particular performance requirement.

The foregoing descriptions of the invention relate to configurations in which the sensitivity of the apparatus is determined as a consequence of the combined effect of two or more angle-sensitive segments arising from their disposition about a rotational axis of symmetry. Alternatively two or more such segments may be employed distributed along a coplanar axis which may be straight or curved with the outputs from these segments combined in phase and amplitude in a manner similar to that employed by the well known techniques of phased arrays or aperture synthesis.

Similarly, two or more such arrays may themselves be combined to provide data in more than one plane.

In the configurations of the invention described it has been assumed that the direction of the applied magnetic field is coplanar with the direction of propagation of the energy in the incident wave and its associated magnetic field component. While this disposition is clearly such as to optimise the interaction between the appalied field and the incident wave, in certain practical situations it may be more convenient to apply the magnetic field at an angle $\phi$ to this plane. In such situations, the quantity $H_o$ in Polder's equation must be multiplied by $\cos\phi$, but provided that $\phi \neq 90°$ a sufficiently high value of $H_o$ will permit the operation of the invention in the manner described. In such cases also it may prove more convenient to operate with a value of $\theta$ markedly different from 45°.

The derivation of Polder's equation on which the foregoing considerations are based assumes a semi-infinite sample of isotropic ferrite material. In practice where a relatively small sample of nonisotropic material will generally be employed, these assumptions are not valid and in addition, the conditions for propagation of the wave components will be modified by the electrical properties of the structure in which the ferrite is mounted. An exact solution of the accurately modified equations is in many cases not possible either by analytic or numerical methods and, in these cases therefore, empirical techniques based upon experiment are required to provide correct values of the parameters for the design of a specific form of apparatus. The description of the principle of this invention in terms of the variations within the PQ plane is nevertheless qualititatively valid as a basis for determination of the directive properties of a particular configuration.

The expression for $\Lambda$ derived above is obtained as a result of a partial differentiation with the input frequency assumed constant. It is however inherent in Polder's equation that changes in input frequency will also give rise to changes in refractive index and hence to impedance. Thus, signals at frequencies other than that for which a particular apparatus is designed will give spurious angular responses and it is therefore desirable to provide means for discrimination against this, analogous to the means by which a conventional antenna has low sensitivity to signals off the beam axis, known generally as side lobes.

From the nature of this invention it is clear that a particularly appropriate technique is that of magnetostatic surface waves, by which the propagation of an electro-magnetic wave in a thin film of magnetised gyrotropic material such as yttrium iron garnet under conditions where the magnetostatic approximations to Maxwell's equations $\nabla\times H=0$ and $\nabla\times B=0$ are valid, yields a response having high variation of velocity versus frequency of the applied signal, i.e. marked dispersion. This phenomena, first analysed by Damon and Esbach has recently been successfully applied by a number of workers in the U.S.A., U.K., and Japan to a construction of various devices in the microwave region and in particular to magnetically tunable filters.

It has further been shown by Yamada and others that, by introducing R.F. energy at a frequency other than that of the incoming signal, amplification of the latter can be obtained through transferring of power from the supplied, or pump, signal to the magnetostatic propagating wave in accordance with the principles of parametric amplification. Thus, by associating these techniques with that for obtaining angular sensitivity as described above, apparatus may be obtained having a response in which, expressed in conventional terms, the beam position, side lobe rejection and gain are each individually controllable by electrical means.

The resulting apparatus is described schematically in FIG. 8 where the angular sensitivity segment at 81 feeds its output to a magnetostatic surface wave filter 82 whose magnetic fields are both supplied from a common source 83. These supplies are controlled individually at 84 and 85 and receive instructions from a programmer at 86 which may be conveniently in the form of a micro-processor. This also provides instructions to a controller 87 and determines the frequency of the parametric amplification pump source 88.

A practical configuration of the apparatus is shown in FIG. 9 where the two opposite segments of a conical structure as earlier described are shown at 91 feeding magnetostatic surface wave filters at 92 with their magnetic sources and controllers mounted at 93 and the pump source at 94. The apparatus receives instructions from the programmer 95. The outputs from the magnetostatic surface wave filters are combined in the processor 96. The angle measurement segments and filters are considered to be distributed continuously about the surface of the cone having the dashed line as its axis.

In all the configurations of this invention described the radiation characteristics of the structures in which the angle sensitive elements are contained will themselves be angle sensitive. It is therefore desirable to provide means for extracting the ferrite sensitive effect from the polar diagram of the mounting, which may conveniently be done by imposing a low frequency modulation in a circuit coupled directly or inductively to the magnetising field. By these means the sensitivity coefficient will be obtained as a variation on this low frequency signal independently of the radiation pattern of the bulk apparatus. This technique also simplifies the signal processing between pairs of segments since A.C. coupling may be employed.

I claim:

1. Apparatus comprising a conical shell formed of a plurality of segments of gyrotropic material, each segment being separated from its two neighbors by an air gap or thin layer of dielectric material;

magnetic means disposed in said shell for producing a magnetic field through said gyrotropic material normal to the plane of said shell; and signal transmission means coupled to each segment for transmitting radio-frequency voltages produced in a radial direction in said gyrotropic material by incident radio-frequency radiation.

* * * * *